United States Patent [19]

Wang

[11] Patent Number: 5,024,215

[45] Date of Patent: Jun. 18, 1991

[54] BACK RACK FOR ALLEVIATING MUSCULO-SKELETAL TENSION

[76] Inventor: Jason Wang, 2245 Watt St., Reno, Nev. 89509

[21] Appl. No.: 421,111

[22] Filed: Oct. 13, 1989

[51] Int. Cl.[5] ..... A61H 1/02

[52] U.S. Cl. ..... 128/75; 272/144; 128/69

[58] Field of Search ..... 128/24 R, 25 R, 44, 128/60, 69, 75, 62 R; 272/135, 136, 137, 138, 141–144

[56] References Cited

U.S. PATENT DOCUMENTS

| | | | |
|---|---|---|---|
| 712,375 | 10/1902 | Hartford | 128/69 |
| 1,265,083 | 5/1918 | Hoard . | |
| 1,572,794 | 2/1926 | Hamilton | 128/69 |
| 1,833,426 | 11/1931 | Knudson | 128/62 R |
| 2,343,204 | 2/1944 | Paton . | |
| 3,672,360 | 6/1972 | Langhammer . | |
| 3,881,469 | 5/1975 | Kanemitsu . | |
| 4,126,129 | 11/1978 | Rainbow | 128/67 |
| 4,207,878 | 6/1980 | Duncan | 128/69 X |
| 4,210,134 | 7/1980 | Okazaki et al. . | |
| 4,350,152 | 9/1982 | Strakowski | 128/24 R |
| 4,352,491 | 10/1982 | Bellia . | |
| 4,414,963 | 11/1983 | Kunz | 128/60 |
| 4,475,542 | 10/1984 | Brossard | 128/69 |
| 4,509,510 | 4/1985 | Hook | 128/60 X |
| 4,520,798 | 6/1985 | Lewis . | |
| 4,583,731 | 4/1986 | Crivello et al. . | |
| 4,736,735 | 4/1988 | Yong . | |
| 4,777,678 | 10/1988 | Moore | 128/69 X |

FOREIGN PATENT DOCUMENTS

| | | | |
|---|---|---|---|
| 645391 | 5/1937 | Fed. Rep. of Germany | 128/62 R |

*Primary Examiner*—Richard J. Apley
*Assistant Examiner*—Linda C. M. Dvorak
*Attorney, Agent, or Firm*—Russell W. Illich

[57] ABSTRACT

A muscle relaxing device for relieving musculo-skeletal tension within a person's back, neck, shoulders, and feet developed from daily activities. The device includes an inclined ramp with a pair of curved projections at its upper end. The projections are for applying pressure to the thoracic area of a person'back. Adjustable pins extend outwardly from the ramped surface and can be used to relieve specific points of pain within a person's neck and feet. A pair of curved levers extend laterally of said ramp and may be pivoted downwardly to apply pressure to a person's shoulders and relieve musculo-skeletal tension within the top of the shoulder area. The entire device is compact and portable. It may be used comfortably at home or anywhere else.

8 Claims, 3 Drawing Sheets

BACK RACK FOR ALLEVIATING MUSCULO-SKELETAL TENSION

BACKGROUND OF THE INVENTION

The natural structure of the human spine in the thoracic area is generally curved posteriorly. Many normal daily activities which a person undertakes can induce an over-extension of muscles in the back due to the curved nature of the spine. Everyday activities such as sitting, typing, driving, or sleeping can cause this tension to occur, particularly if the posture is improper. The over-extension of the muscles can affect the upper and middle back, shoulders, and neck and may cause headaches in some individuals.

Some activities have been shown to assist in the reduction of muscle stress induced by daily living. Such activities include swimming, gymnastics, yoga, and some aerobic exersises. These activities provide for some balance of the stress in the shoulder, back, and neck areas and relieve musculo-skeletal tension. However, many individuals fail to participate in these "balancing" activities or cannot find the time to participate in these activities to enough degree to balance all of the musculo-skeletal tension which builds from daily activities. Hence, a device or activity is needed which will alleviate certain types of musculo-skeletal tension and that can be conducted quickly and efficiently for persons whose daily schedules do not permit them to participate in other types of athletic activities.

There are currently a number of devices that assist in alleviating certain types of musculo-skeletal tension . The U.S. Pat. Nos. 4,736,735; 4,583,731; 4,352,491; and 3,881,469 show various types of the therapeutic tables designed to relieved tension within certain areas of the back. The primary disadvantage of these devices is that they are bulky and expensive so that they are generally restricted to use in clinics and hospitals and are not practical for home use. Additionally, these devices are used for general areas or for exercise, not for specific points within the shoulders, neck, and back. The U.S. Pat. Nos. 4,520,798 and 4,210,134 show two smaller devices but these devices address only general areas of the back or neck area for relieving stress and are not efficient because the devices do not provide enough pressure on specific points of the back or neck. The U.S. Pat. Nos. 3,672,360 and 2,343,204 show simple devices for relieving stress along the entire length of the back; however, these devices fail to provide specific tension relief within the neck and shoulder regions of the back. The U.S. Pat. No. 1,265,083 shows a device that does provide for tension relief within specific points of the neck and shoulders. The primary disadvantage of this device is that both pins directed toward the neck extend at the same height and the two levers pivot together. This arrangement places twice the pressure than required on the shoulders and neck if the pain is concentrated in one specific area on the neck or within only one of the shoulders. This device also fails to relieve tension within the back and rhomboid muscles.

The present invention improves upon all of the devices previously patented by relieving tension along the upper and middle back, between the shoulders, above the shoulders, and at specific areas of the body such as the neck and sole of the foot. The present invention also is simple in design and is easily used within the home or office.

SUMMARY OF THE INVENTION

The present invention is a device that uses an inclined block that extends longitudinally along the length of a person's back. The block includes adjustable pins at the top and bottom of the inclined plane. These pins allow muscle tension to be alleviated at the neck and on the sole of the foot, also included on the block are a pair of pivotable handles which may be rotated upwardly while the spine is positioned on the block to relieve tension of the trapezius muscles at the top of the shoulders. Curved projections are provided at the top of the ramp for putting pressure on the longissimus muscles on both sides of the middle and upper back.

It is an object of this invention to provide a device that releives tension of the head, neck, between and on the top of the shoulders, and upper and middle back.

It is a further object of the invention to provide a device which is compact, simple to manufacture, easy to use, and low in cost so that the device may be portable and used conveniently at home or away from home.

Other objects of the invention will be apparent hereinafter from the specification and from the recital of the appended claims, particularly when read in conjunction with the accompanying drawings.

DETAILED DESCRIPTION OF THE INVENTION

Figure 2:
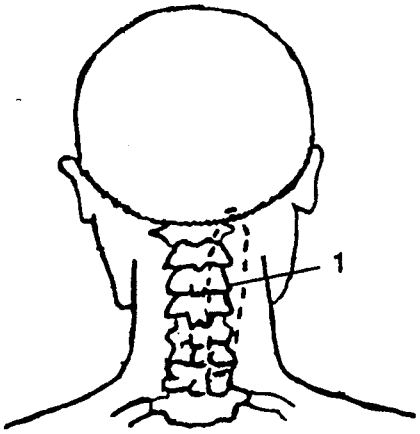
FIG. 2 shows a rear view of a person's head and neck areas.
Figure 1:
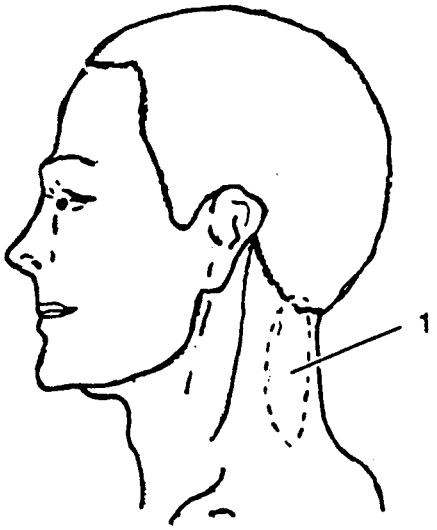
FIG. 1 shows a side view of a person's head and neck areas.
Figure 3:
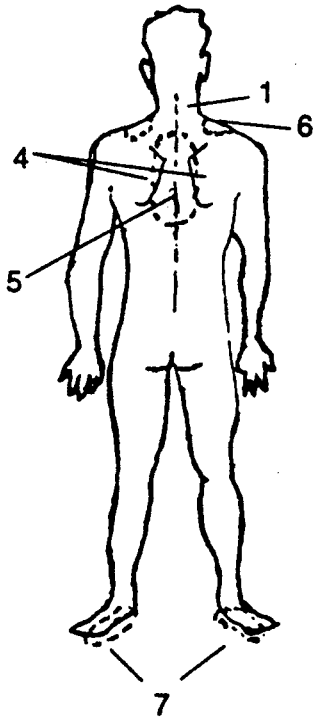
FIG. 3 shows a rear view of a person's entire back and shoulder areas.

The present invention involves a device which acts as a back rack for alleviating certain types of musculo-skeletal tension caused by daily activities. FIGS. 1–3 show the sensitive areas where the device is most apt to be used. The natural structure of the human spine in the thoracic area is generally curved posteriorly. The curvature is especially emphasized between the 2nd and 9th vertebrae shown in FIG. 3, area 5. Many daily activities such as sitting in a soft chair, typing or writing at a low desk, or sleeping with a high pillow can induce over-extension of the muscles within the cervical and thoracic areas, shown as area 1 in FIGS. 1 and 2 and area 5 in FIG. 3, respectively, Many of these activities also tend to pull the scapulas 4, shown in FIG. 3, toward the lateral aspect of the back and away from the medial section 5 of the back. This type of posture can also cause muscle tension within the upper and middle back 5, the shoulders 4 and 6, and the neck 1.

Figure 4:
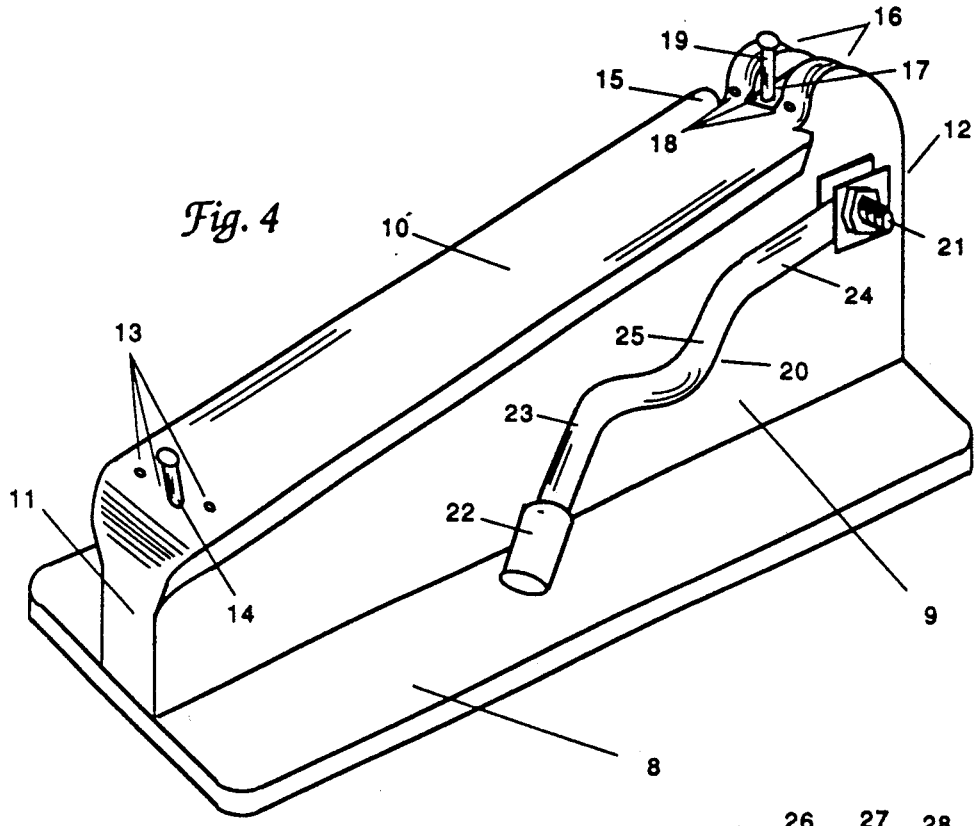
FIG. 4 shows a perspective view of the back rack device.
Figure 6:
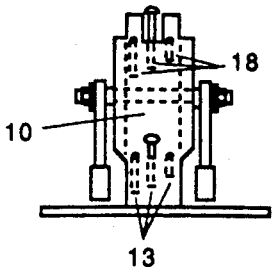
FIG. 6 shows an end plan view of the device of FIG. 4.

FIG. 4 shows the back rack device used to relieve musculo-skeletal tension within the back, neck and shoulders. Additionally, the device could be used to increase circulation within the feet 7, as viewed in FIG. 3. The device includes a base plate 8 and a block 9 rigidly connected to the base plate. The base plate and block have a longitudinal dimension approxiamtely the same size of an average sized back. The block 9 includes a widened ramp 10 at its top surface. The ramp is inclined from a low end 11 of block 9 to a high end 12 of the block. The ramp includes three adjustment holes 13 at its lower end for holding a pin 14. The adjustment holes 13 are of three different depths, as best seen in the end view of the device in FIG. 6. The variation of the depths of the holes allow the pin to be adjustably set at different heights depending on the user's preference or needs. At the upper end 15 the ramp narrows to the general width of block 9. The block 9 includes a pair of curved projections 16 at its high end 12. Between the projections is a flat section 17. The two projections 16 and flat section 17 each have an adjustable hole 18 of varying depths the same as adjustment holes 13. The adjustment holes 18 hold a pin 19 which may be adjustably set within one of the three holes 18 as pin 14 is set within one of the holes 13. Pins 14 and 19 include mushroom shaped heads at their respective ends as best seen in the side view of the device shown in FIG. 7. Also, each of the adjustment holes 13 and 18 are disposed at an angle with the outer surface of the ramp which may vary from 75°-105°.

Figure 5:
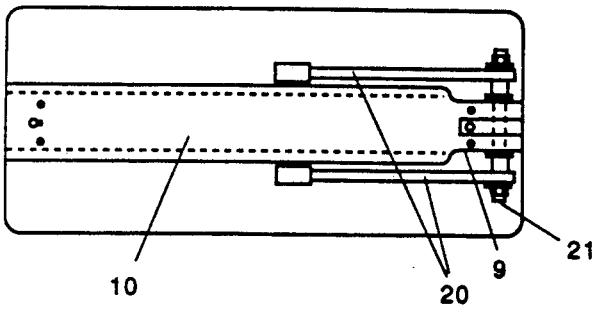
FIG. 5 shows a top plan view of the device of FIG. 4.
Figure 8:
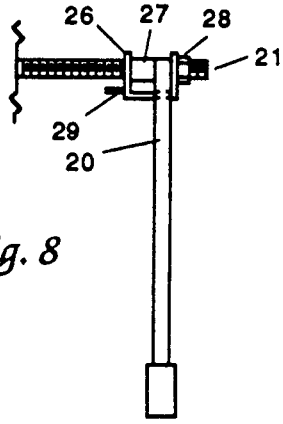
FIG. 8 shows a partial view of the handle and pivot axle of the device of FIG. 4.
Figure 7:
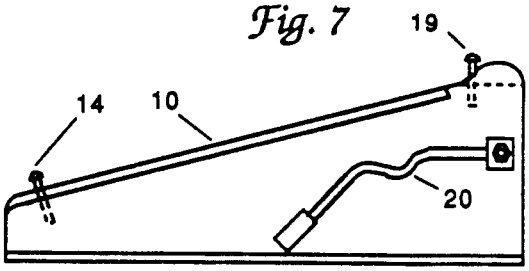
FIG. 7 shows a side plan view of the device of FIG. 4.

Another significant feature of the back rack are a pair of levers 20 disposed in a side-by-side relationship with the block 9 and the ramp 10 as best seen in the top view of the device shown in FIG. 5. The levers are rigidly connected to a common hinge pin 21 that extends through the block at its high end 12. The levers further include handles 22 at their respective ends. FIGS. 4 and 7 clearly show the curved nature of these levers. The lever includes two straight sections 23 and 24 at its respective ends and a downwardly curving middle section 25 between the straight section. Each of the sections are disposed at different angles with respect to each other. Details of the hinged connection of the lever to the block can best be seen in FIG. 8. The lever 20 is mounted on the hinge pin 21 which includes screw threads on its outer surface. The lever is held against the outer edge of the block by a horseshoe washer 26. Between the washer and the lever is disposed a spacing sleeve 27 to allow the lever to pivot upwardly and not interfere with the widened ramp 10. The washer, sleeve, and lever are all secured in place by a threaded nut 28 which is screwed onto the end of the hinge pin 21. The stabilizing pin 29 connects the washer assembly to the block 9, preventing the assembly from rotating as the lever 20 is raised and lowered.

Figure 9:
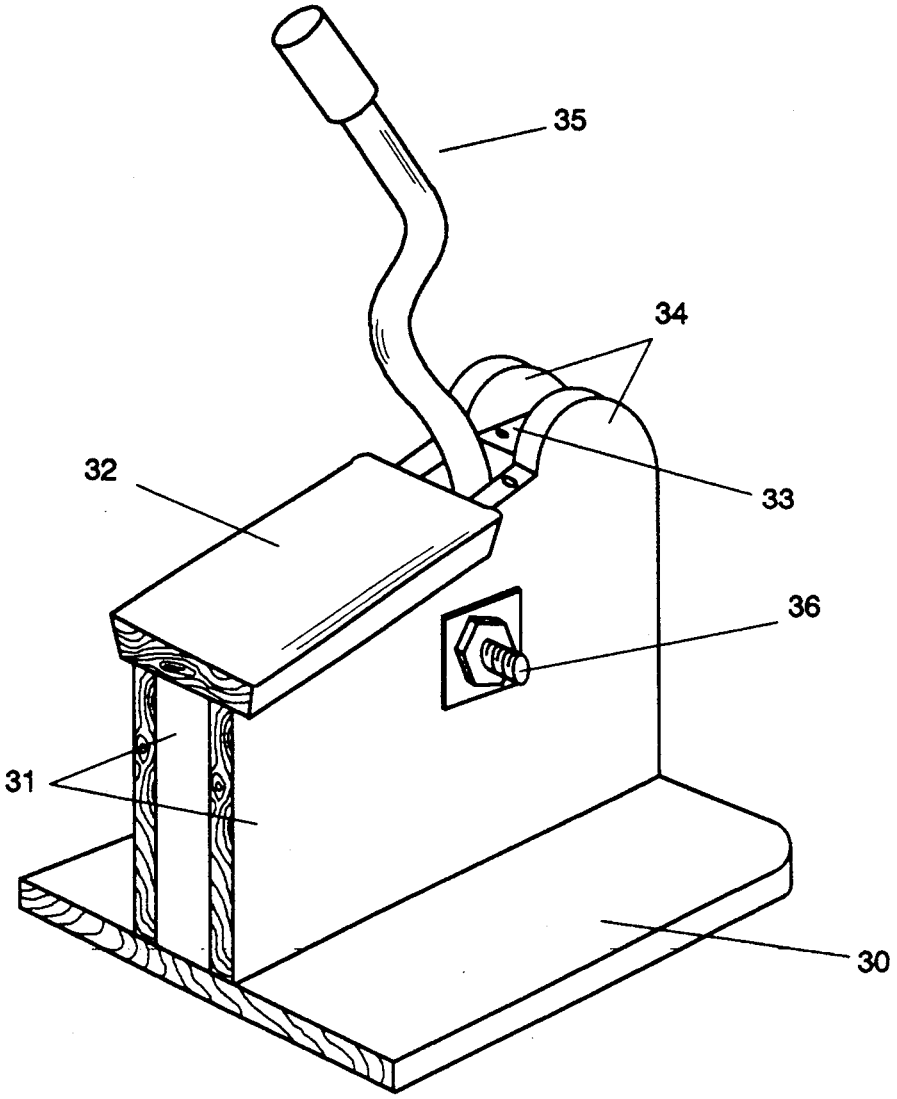
FIG. 9 shows a partial perspective view of a second embodiment of the back rack device.
Figure 10:
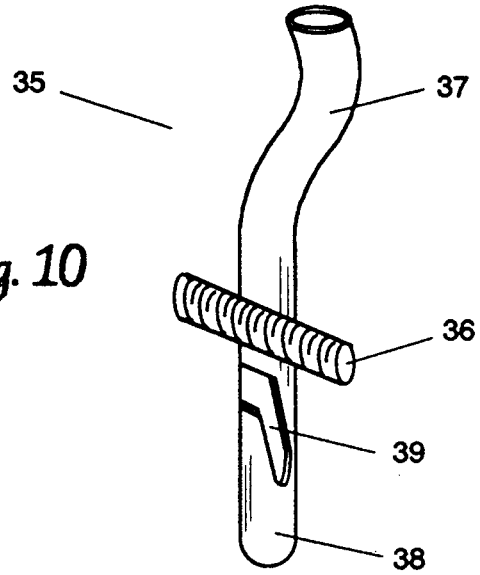
FIG. 10 shows a cutaway perspective view of the attachment of the handle to the pivot axle of the embodiment of FIG. 9.

A second embodiment of the back rack deevice is shown in FIGS. 9 and 10. Referring to FIG. 9 a base 30 is used for mounting a pair of inclined supports 31. At the top of the supports lies an inclined ramp 32 which extends most of the way up the supports 31. The supports are mounted between a block 33. The upper end of the supports also include curved projections 34. A pivotable lever 35 is attached to a pivot axle 36 and extends upwardly between the end of the ramp 32 and block 33.

FIG. 10 shows details of the connection between the lever 35 and pivot axle 36. The lever has its central curved section 37 facing outwardly towards the lower end of the ramp (not shown in FIG. 10). At the end 38 of the lever is cut an angled slot 39. The front opening of the slot faces the upper end of the ramp and extends downwardly toward the base (also not shown in FIG. 10). The lever 35 may be attached to the axle 36 by extending the end 38 downwardly between the end of the ramp 32 and block 33 until the mouth of slot 39 comes into contact with the threaded axle 36 as shown in FIG. 10. The lever is then pulled upwardly such that the bottom of the angled slot 39 is pulled up onto the axle 36. In use, when the lever is pivoted downwardly towards the ramp 32, the nature of the angled slot keeps the lever attached to the pivot axle 36. The lever 35 may also be used as a convenient carrying handle for transporting the back rack device.

Operation and use of the back rack is herein described. In its first use the pins 14 and 19 are removed from the device and the user positions his/her lower back against the end 11 of block 9 in a sitting position. To relieve the tension within the center of the back and thoracic area the user then lowers his/her back until the spine comes to rest against ramp 10 and the thoracic area of the back rest against the curved projections 16. A sudden motion of the back downwardly over the projections can cause the back to "crack" which relieves tension of the thoracic area. To relieve tension within the central back area the user hooks his/her hands behind the head slightly moves his/her elbows together while relaxing the upper body. This process should be repeated several times and the user should move up and down the ramp 10 to work different areas of the middle and upper back. As the elbows are spread laterally back to a horizontal position and the scapulas are placed on both sides of projections 16, pressure is exerted against the user's scapulas which relieves tension of the rhomboid muscles.

To relieve tension within the user's shoulders, the levers 20 are raised all the way up until the section 24 lies vertical to the base plate 8. The back is then positioned downwardly onto the ramp 10 with the neck on top of projections 16. The handles 22 are then grasped and pulled downwardly to exert pressure against the top of the user's shoulders. The central curved portion 25 of lever 20 presses against the top of the shoulder to relieve tension. It is the curvature of the lever which makes it most effective in relieving tension in the top of the trapezius muscles. The embodiment of FIGS. 9 and 10 achieve the same result using a single lever 35 which can exert pressure on either shoulder of a user when his/her back is positioned off-center of the ramp 32. Additionally, the entire back rack device may also be used against a wall or piece of furniture when using the lever 35 or levers 20 to relieve tension within the shoulders. In this case, the lever(s) is/are grasped and the block is pulled to a vertical position whereupon the user leans his/her back against the block and pulls the lever(s) down upon the affected points of the shoulder(s).

In cases where specific points of pain within the neck and head have developed the user should use one of the pins 14 or 19 which should be inserted into one of the three holes 13 or 18 of varying depth, respectively. The user may lay on the floor with the neck positioned on top of pin 14, or lay on the ramp 10 with the neck positioned on pin 19. Circulation of the blood in a user's feet may also be improved by placing the painful spot of the sole of the foot on top of one of the pins 14 or 19 of the ramp 10 with the user in a sitting position. The curved projections 16 of block 9 may also be used to relieve tension of the sole of the feet by the same process as used with pins 14 or 19.

Used properly, the back rack can work effectively as a self-help tool for accupressure and massage. The device can relieve stress/muscle tension of the neck, middle back, upper back, and shoulders. It can also be used to improve circulation of the feet and relieve stress induced headaches. The device can also function as a stretching tool for the back before and after engaging in athletic activities.

It should be apparent that many modifications could be made to the back rack which would still be encompassed within the spirit of the present invention. It is intended that all such modifications may fall within the scope of the appended claims.

What is claimed is:

1. A muscle relaxing device comprising:

a base plate adapted to rest in a stable position against a flat surface, said base plate having a longitudinal dimension of at least the length of a small person's back;

an inclined block mounted on said base plate, said block having a lower end and an upper end at a depth significantly higher than said lower end, said block having a longitudinal dimension approximately equal the longitudinal of said base plate;

a flat ramped surface extending along one side of said inclined block opposite from said base plate, said ramped surface having lower and upper ends, said ramped surface having a lateral dimension slightly wider than the width of a person's spine;

said inclined block further comprising projecting means extending upwardly from said higher end of said block, said projecting means having at least one curved surface which connects with said ramped surface at said upper end of said ramped surface, said projecting means having a lateral dimension slightly wider than the width of a person's thoracic area of the spine;

wherein tension within the muscles of a person's back may be relieved by lying down upon said curved surface of said projecting means;

wherein said ramped surface further comprises a hole, said hole extending downwardly into said block;

a pin of a dimension to be held by said hole, wherein a point of pain within a person's neck or foot may be relieved by applying pressure to the point of pain against said pin when said pin is held within said hole.

2. A muscle relaxing device as claimed in claim 1, wherein said projecting means comprises a pair of projections and a flat surface disposed between said projections, said curved surface stretching across an exterior surface of each of said projections.

3. A muscle relaxing device as claimed in claim 1, wherein said ramped surface comprises at least two holes capable of holding said pin, said holes being of varying depth such that the height of said pin above said ramped surface may be adjusted depending upon which hole holds said pin.

4. A muscle relaxing device as claimed in claim 1, wherein said hole forms an angle with said ramped surface between 75° and 105°.

5. A muscle relaxing device as claimed in claim 1, wherein said pin has an enlargement opposite the end which is inserted within said hole, said enlargement having a curved surface.

6. A muscle relaxing device comprising:

a base plate adapted to rest in a stable position against a flat surface, said base plate having a longitudinal dimension of at least of a small person's back;

an inclined block mounted on said base plate, said block having a lower end and an upper end at a depth significantly higher than said lower end, said block having a longitudinal dimension approximately equal the longitudinal dimension of said base plate;

a flat ramped surface extending along one side of said inclined block opposite from said base plate, said ramped surface having lower and upper ends, said ramped surface having a lateral dimension slightly wider than the width of a person's spine;

said inclined block further comprising projecting means extending upwardly from said higher end of said block, said projecting means having at least one curved surface which connects with said ramped surface at said upper end of said ramped surface, said projecting means having a lateral dimension slightly wider than the width of a person's thoracic area of the spine;

wherein tension within the muscles of a person's back may be relieved by lying down upon said curved surface of said projecting means;

further comprising a lever pivotally attached to said inclined block, said lever disposed in a plane substantially perpendicular to said ramped surface, said lever capable of rotating above said ramped surface and applying pressure to a person's shoulders when the person lies with his/her back against said ramp, grasping said lever and pulling downwardly upon said lever.

7. A muscle relaxing device as claimed in claim 6, wherein said lever has at least two longitudinal sections disposed at an angle relative to each other.

8. A muscle relaxing device as claimed in claim 6, further comprising a second lever, said first and second levers disposed on opposite sides of said inclined block, said two levers are capable of rotation independent from one another.

* * * * *